US009851678B2

(12) United States Patent
Kubo

(10) Patent No.: US 9,851,678 B2
(45) Date of Patent: Dec. 26, 2017

(54) BLOWING DEVICE, HOLDER FOR BLOWING DEVICE, SHEET DISCHARGE DEVICE, AND IMAGE FORMING APPARATUS

(71) Applicant: Sharp Kabushiki Kaisha, Osaka-shi, Osaka (JP)

(72) Inventor: Takashi Kubo, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/534,961

(22) Filed: Nov. 6, 2014

(65) Prior Publication Data

US 2015/0147103 A1 May 28, 2015

(30) Foreign Application Priority Data

Nov. 22, 2013 (JP) ..... 2013-242344

(51) Int. Cl.

| | |
|---|---|
| ***G03G 15/00*** | (2006.01) |
| ***F04D 29/58*** | (2006.01) |
| ***F04D 29/60*** | (2006.01) |
| ***B65H 31/02*** | (2006.01) |
| ***F04D 29/42*** | (2006.01) |
| ***F04D 17/08*** | (2006.01) |
| ***F04D 17/16*** | (2006.01) |
| ***G03G 21/20*** | (2006.01) |

(52) U.S. Cl.

CPC ..... *G03G 15/6552* (2013.01); *B65H 31/02* (2013.01); *F04D 17/08* (2013.01); *F04D 17/16* (2013.01); *F04D 29/584* (2013.01); *F04D 29/601* (2013.01); *G03G 21/206* (2013.01); *B65H 2301/4212* (2013.01); *B65H 2301/5144* (2013.01); *B65H 2406/12* (2013.01)

(58) Field of Classification Search

CPC ..... G03G 21/206; G03G 2221/1645; B65H 2301/5144; F04D 29/4226; F04D 29/4246; F04D 29/4253; F04D 17/08; F04D 17/16; F05D 2250/52; B41J 29/377

USPC ..... 415/213.1, 214.1

See application file for complete search history.

(56) References Cited

U.S. PATENT DOCUMENTS

| | | | | |
|---|---|---|---|---|
| 2003/0095349 | A1* | 5/2003 | Inamoto | F04D 17/08 359/889 |
| 2003/0189695 | A1* | 10/2003 | Arai | G03B 21/10 353/77 |
| 2012/0114346 | A1* | 5/2012 | Kurotsu | G03G 15/2042 399/45 |

FOREIGN PATENT DOCUMENTS

| | | | |
|---|---|---|---|
| JP | 2000-297783 | A | 10/2000 |
| JP | 2008-88985 | A | 4/2008 |
| JP | 2012-155113 | A | 8/2012 |

* cited by examiner

*Primary Examiner* — R. A. Smith
*Assistant Examiner* — John M Royston
(74) *Attorney, Agent, or Firm* — Birch, Stewart, Kolasch & Birch, LLP

(57) ABSTRACT

A blowing device is equipped with a blowing portion and a holder. The blowing portion has a cylindrical body that stores a rotating body, and includes: a suction inlet arranged on a side surface perpendicular to the axial direction of the cylindrical body; and an exhaust outlet arranged on a part of the peripheral surface of the cylindrical body. The holder has a wall that faces the peripheral surface of the blowing portion with a gap between the wall and the peripheral surface, and holds the blowing portion inside. The holder includes: a suction portion that communicates with the suction inlet; and an exhaust portion that causes the exhaust outlet to communicate with the outside and the gap.

10 Claims, 8 Drawing Sheets

BLOWING DEVICE, HOLDER FOR BLOWING DEVICE, SHEET DISCHARGE DEVICE, AND IMAGE FORMING APPARATUS

CROSS REFERENCE

This Nonprovisional application claims priority under 35 U.S.C. §119(a) on Patent Application No. 2013-242344 filed in Japan on Nov. 22, 2013, the entire contents of which are hereby incorporated by reference.

BACKGROUND OF THE INVENTION

The present invention relates to a blowing device that suctions gas from a suction inlet of a blowing portion and exhausts the gas from an exhaust outlet, to a holder that configures a part of the blowing device, to a sheet discharge device equipped with the blowing device near a sheet discharge port to a sheet discharge tray, and to an electrophotographic image forming apparatus equipped with the blowing device between a fixing portion and a sheet discharge portion.

An electrophotographic image forming apparatus, after heating and pressurizing at a fixing portion a sheet of paper bearing a toner image transferred to the sheet of paper, discharges the sheet of paper to a sheet discharge tray. During continuous image formation with respect to a large number of sheets of paper, the large number of sheets of paper heated at the fixing portion are stacked and stored on the sheet discharge tray, so that each of the sheets of paper is held between other upper and lower sheets of paper on the sheet discharge tray and is likely to be left in a high temperature.

In particular, in a so called in-body sheet discharge type image forming apparatus in which a sheet discharge tray is arranged between an image reading portion and a sheet storage portion, heat dissipation of the sheets of paper is insufficient, and, during continuous image formation, a large number of sheets of paper are stacked and stored on the sheet discharge tray while being still in a high temperature. As a result, due to addition of the weight of upper sheets of paper, a toner image is retransferred onto a sheet of paper of which the upper surface contacts the sheet of paper bearing the toner image, which causes degradation of image quality and stain of the sheet of paper.

In view of the foregoing, some conventional image forming apparatuses include a blowing device arranged at a discharge port to a sheet discharge tray and are configured to cool the sheets of paper discharged to the sheet discharge tray by applying air to the sheets of paper. The sheets of paper heated at the fixing portion are cooled down by blowing air before the sheets of paper are stored on the sheet discharge tray, and a large number of sheets of paper are prevented during continuous image formation from being stacked and stored on the sheet discharge tray while being still in a high temperature, which thus can prevent degradation of image quality and stain of a sheet of paper.

In the image forming apparatus, a reduction in size has been strongly requested, a space between the fixing portion and the sheet discharge port is narrow, and therefore a blowing device needs to be configured in a small size. Thus, for example, in a configuration disclosed in Japanese Patent Laid-Open Publication No. 2000-297783, a sirocco fan is used, the sirocco fan being equipped with a cylindrical casing; and a dish including a number of fins that are annularly raised on the peripheral edge portion of the disk.

The sirocco fan, by rotation of the disk in the casing, discharges gas suctioned into the casing in the axial direction of the casing, from an exhaust outlet formed on the peripheral surface of the casing to the outside. The lengths of the casing and the fin in the axial direction are formed short and a motor that supplies a rotational force to the disk is arranged inside the fin, and a blowing device can thereby be formed small.

However, since such a blowing device applied to an image forming apparatus for the purpose of cooling of a sheet of paper to be discharged to a sheet discharge tray is arranged close to a high-temperature fixing portion, the blowing device itself is affected by the heat from the fixing portion, which makes the cooling of a sheet of paper insufficient and causes modification or breakage of each portion, failure of a motor, or the like. In particular, if a motor as a heat generating source as well is arranged inside a fin, an internal temperature will further easily rise during continuous use.

The occurrence of these problems such as rise in blowing temperature, breakage, and failure is not limited to a case in which a blowing device is applied to an image forming apparatus but a general problem in the blowing device used in a comparatively high temperature environment.

An object of the present invention is to provide a blowing device capable of suppressing temperature rise in the blowing device and preventing occurrence of rise in blowing temperature, breakage, and the like, by leading part of the gas exhausted from the blowing device to the inside of the blowing device. Another object of the present invention is to provide a sheet discharge device capable of sufficiently cooling a sheet of paper discharged to a sheet discharge tray by applying this blowing device, and to provide an image forming apparatus capable of thereby continuously preventing degradation of image quality or stain of a sheet of paper during continuous image formation.

SUMMARY OF THE INVENTION

A blowing device according to preferred embodiments of the present invention is equipped with a blowing portion and a holder. The blowing portion has a cylindrical body that stores a rotating body, and includes: a suction inlet arranged on a side surface perpendicular to the axial direction of the cylindrical body; and an exhaust outlet arranged on a part of the peripheral surface of the cylindrical body. The holder has a wall that faces the peripheral surface of the blowing portion with a gap between the wall and the peripheral surface, and holds the blowing portion inside. The holder includes: a suction portion that communicates with the suction inlet; and an exhaust portion that causes the exhaust outlet to communicate with the outside and the gap.

A holder for a blowing device according to preferred embodiments of the present invention has a wall that faces the peripheral surface of the blowing portion with a gap between the wall and the peripheral surface, holds the blowing portion inside, and includes: a suction portion that communicates with a suction inlet; and an exhaust portion that causes an exhaust outlet to communicate with the outside and the gap.

A sheet discharge device and an image forming apparatus according to preferred embodiments of the present invention include the blowing device with any of the above described configurations, the blowing device being arranged so that the exhaust portion is exposed at a sheet discharge port for discharging a sheet of paper to a sheet discharge tray.

The foregoing and other features and attendant advantages of the present invention, will become more apparent from the reading or the following detailed description of the invention in conjunction with the accompanying drawings.

DETAILED DESCRIPTION OF THE INVENTION

Hereinafter, a blowing device according to preferred embodiments of the present invention, and an image forming apparatus incorporating the blowing device will be described with reference to the attached drawings.

Figure 1:
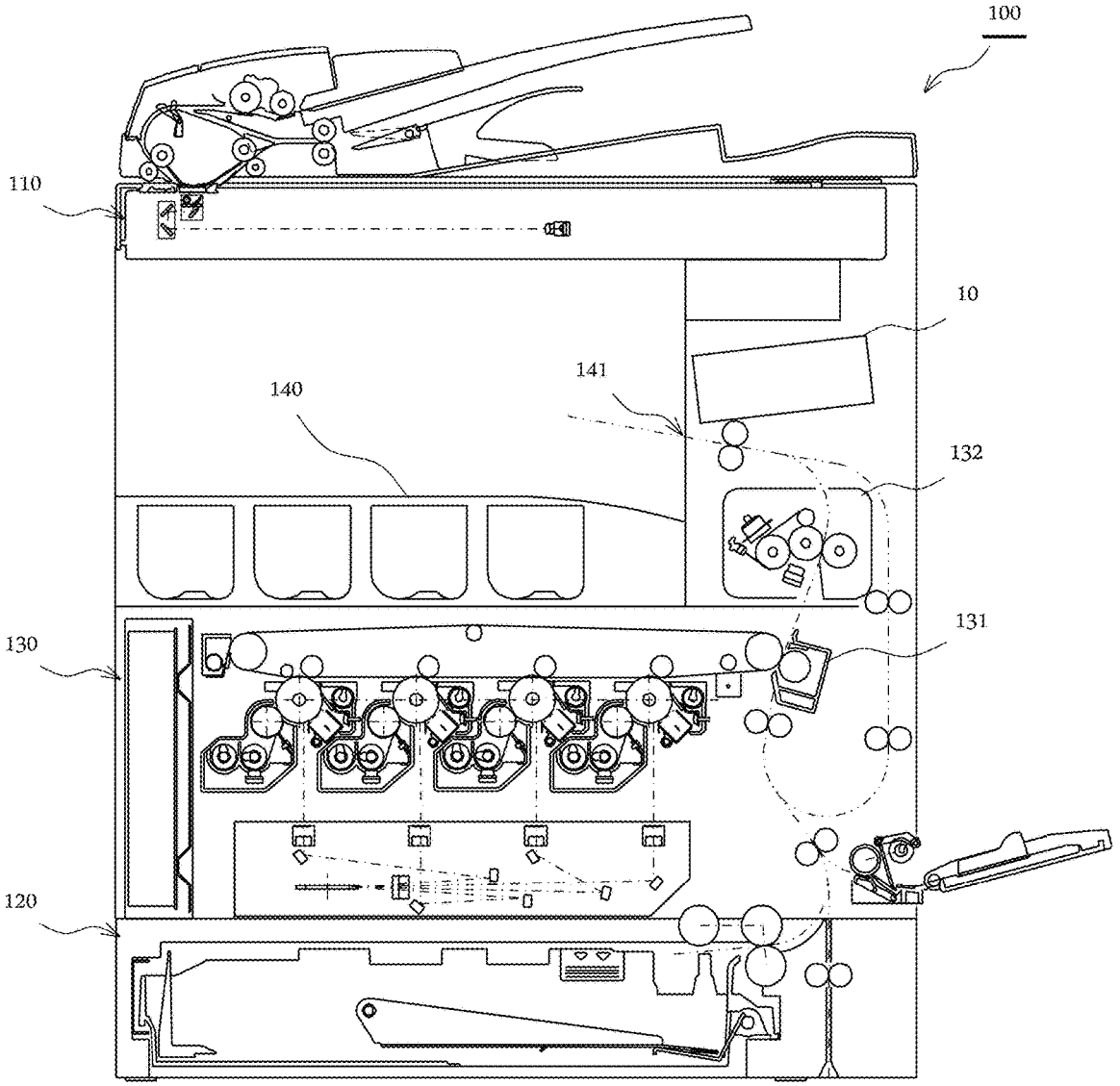
FIG. 1 is a schematic diagram of an image forming apparatus equipped with a blowing device according to a preferred embodiment of the present invention.

As shown an FIG. 1, an image forming apparatus 100 incorporating a blowing device 10 according to preferred embodiments of the present invention is configured to form a polychrome or monochrome image on a sheet of paper by electrophotographic image formation. The image forming apparatus 100 is equipped with a document reading portion 110, a paper supply portion 120, an image forming portion 130, and a sheet discharge tray 140, and, after forming an image on one side or both sides of a sheet of paper in the image forming portion 130, the sheet of paper being supplied from the paper supply portion 120, discharges the sheet of paper to the sheet discharge tray 140.

The image forming portion 130 is equipped with a transfer portion 131 that transfers a toner image onto a sheet of paper, and a fixing portion 132 that heats and pressurizes the sheet of paper that has passed the transfer portion 131. The sheet of paper is heated in the fixing portion 132, and is discharged to the sheet discharge tray 140 in a state in which the toner image is fixed onto the surface of the sheet of paper.

The sheet discharge tray 140 is arranged vertically between the document reading portion 110 and the image forming portion 130 and forms a so called in-body sheet discharge portion. The sheet of paper discharged to the in-body sheet discharge portion after being heated in the fixing portion 132 is inferior in heat dissipation as compared with a case in which a sheet of paper is discharged to a sheet discharge portion exposed to the side face of a device. During continuous image formation, a large number of sheets of paper that are still not cooled down sufficiently are stacked and stored on the sheet discharge tray 140, so that a toner image on a sheet of paper positioned in the middle is retransferred onto other sheets of paper that contact the upper side of the sheet of paper, which is likely to cause degradation of image quality and stain of the sheet of paper.

Therefore, the image forming apparatus 100 includes the blowing device 10 being arranged close to a sheet discharge port 141 above the sheet discharge tray 140 and exhausting air.

Figure 2A:
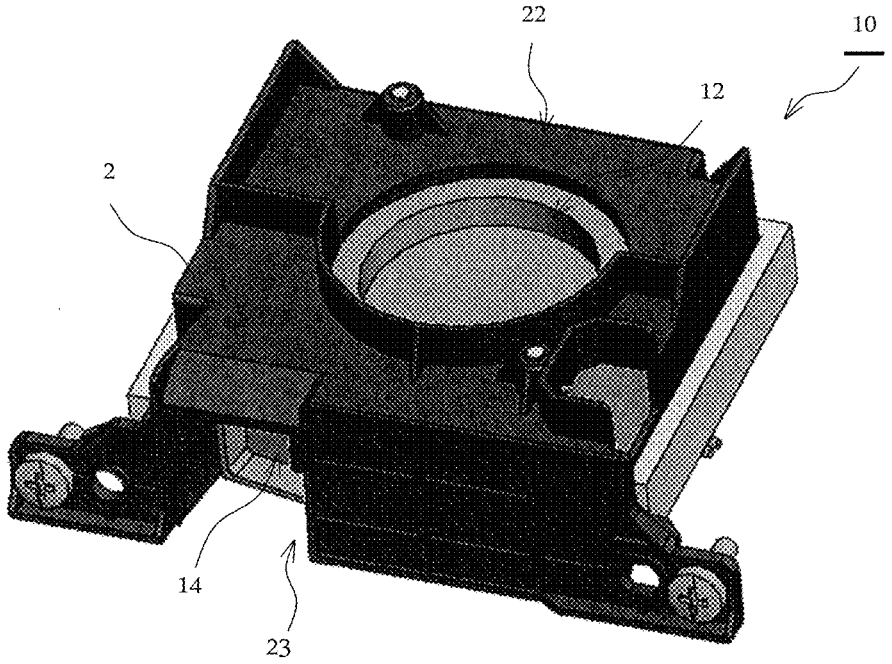
FIG. 2A is an external view showing a blowing device as viewed from an upper side according to a first preferred embodiment of the present invention.
Figure 2B:
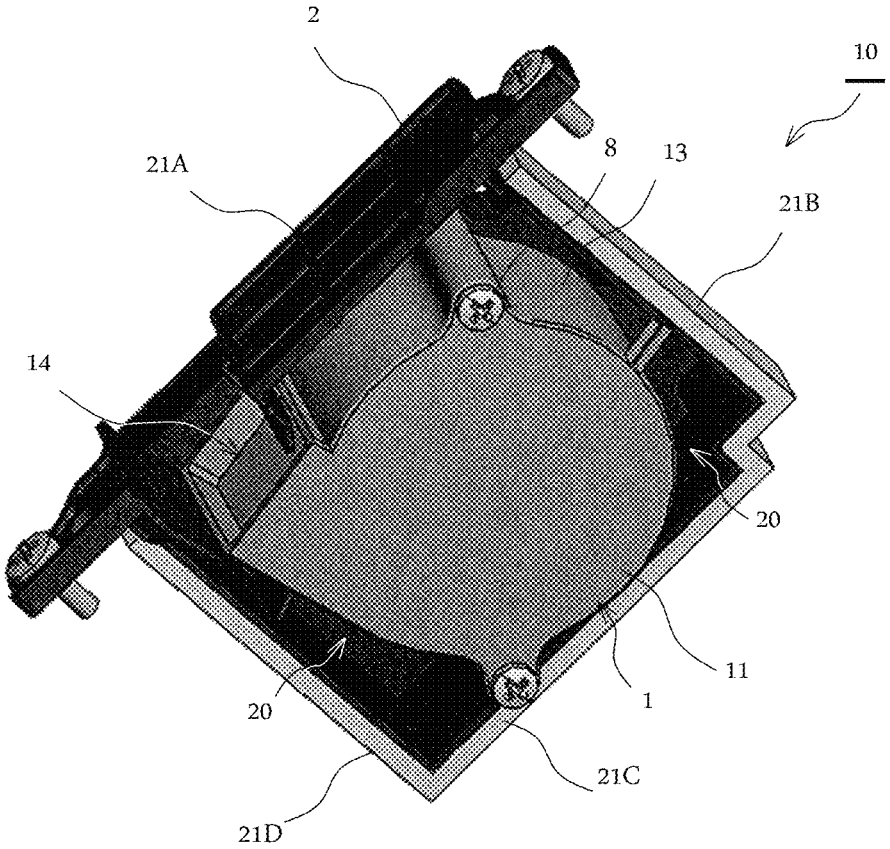
FIG. 2B is an external view showing the blowing device as viewed from a lower side.

As shown in FIG. 2A and FIG. 2B, a blowing device 10 according to a first preferred embodiment of the present invention includes a blowing portion 1 and a holder 2. The blowing portion 1, as an example, is formed of a sirocco fan, and includes: a suction inlet 12 arranged on a side surface perpendicular to the axial direction of a casing 11 as a cylindrical body according to the present invention; and also an exhaust outlet 14 arranged on a part of the peripheral surface 13 of the cylindrical body.

The holder 2 for a blowing device includes four walls 21A to 21D that face the peripheral surface 13 of the casing 11 with a gap 20 between the walls and the peripheral surface and holds the blowing portion 1 inside. The holder 2 includes: a suction portion 22 that communicates with the suction inlet 12; and an exhaust portion 23 that causes the exhaust outlet 14 to communicate with the outside and the gap 20. The blowing portion 1 is fixed to the holder 2 by a screw 8 engaged from the side of the bottom face of the holder 2, the bottom face being open to the outside.

Figure 3:
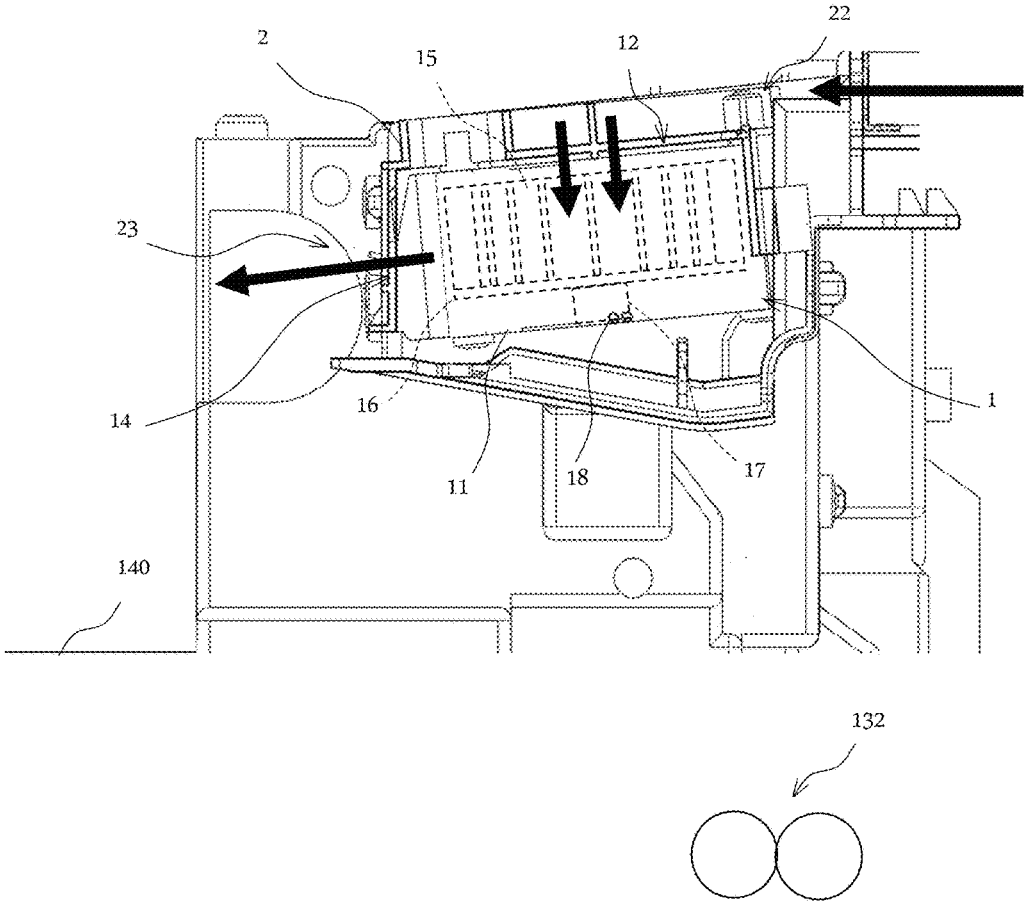
FIG. 3 is a sectional side elevational view of the blowing device.

As shown in FIG. 3, the blowing portion 1 includes a cylindrical casing 11; and a disk 16 (that is equivalent to a rotating body of the present invention) having a number of fins 15 that are annularly raised on the peripheral edge portion of the disk, and, by rotation of the disk 16 in the casing 11, discharges outside air suctioned from the suction inlet 12 into the casing 11 in the axial direction of the casing 11, from the exhaust outlet 14 formed on the peripheral surface of the casing 11 to the outside. It is to be noted that the casing 11, in the central portion inside, stores a motor 17 for supplying a rotational force to the disk. The motor 17 receives supply of power via a cable 18.

When the disk of the blowing portion 1 is rotated, the outside air is suctioned from the suction portion 22 of the holder 2 into the blowing portion 1 by way of the suction inlet 12 of the blowing portion 1, and is then exhausted from the exhaust outlet 14 of the blowing portion 1. The air discharged from the exhaust outlet 14 is exhausted toward the sheet discharge tray 140 mainly by way of the exhaust portion 23 of the holder 2. The sheet of paper that has passed the fixing portion 132 is cooled down by the air exhausted from the exhaust portion 23 of the holder 2 while being discharged toward the sheet discharge tray 140.

Figure 4:
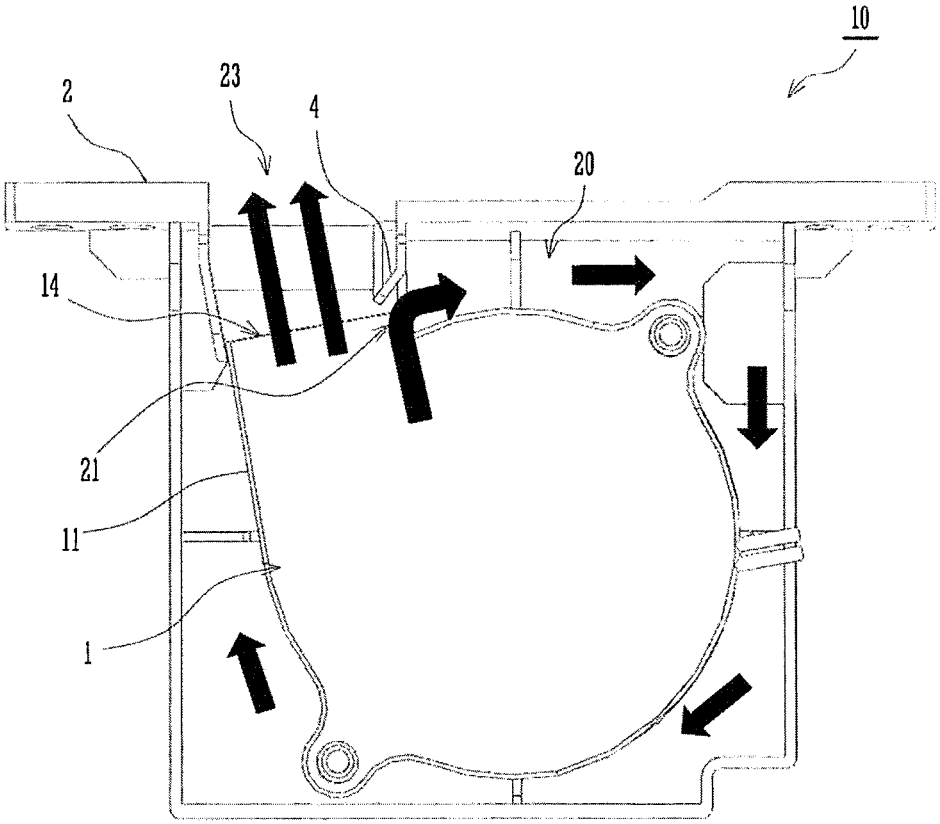
FIG. 4 is a bottom view of the blowing device.

As shown in FIG. 4, the holder 2 of the blowing device 10 may be equipped with a branch portion 4 in the exhaust portion 23. The branch portion 4 is composed of an inclined surface that extends from an edge portion of exhaust portion 23 and faces a part of the exhaust outlet 14 of the blowing portion 1, and leads part of air exhausted from the exhaust outlet 14 to the gap 20 through the opening 21. The air led to the gap 20 passes through the inside of the gap 20 while contacting the peripheral surface of the casing 11. This makes it possible to cool the blowing portion 1 down through the peripheral surface of the casing 11. The holder 2 has a bottom face that is open outward, which allows air that reaches the end of the gap 20 to be emitted from below to the outside of the blowing device 10.

The blowing device 10, because being arranged above the fixing portion 140 in the image forming apparatus 100, is affected by the heat generated in the fixing portion 140. During continuous image formation, the temperature of the blowing portion 1 may rise in combination with heat generation of the motor 17 and may cause modification and breakage of each portion, and a failure of the motor.

The air exhausted from the blowing portion 1 cools the blowing portion 1 itself down, which can reduce the temperature rise of the blowing portion 1, prevent occurrence of breakage or a failure, and reliably continue cooling sheets of paper by the blowing device 10 even during continuous image formation.

It should be noted that two branch portions 4 are arranged across the exhaust outlet 14 so as to lead the part of the air exhausted from the exhaust outlet 14, from the opposite sides of the casing 11 into the gap 20.

Figure 5:
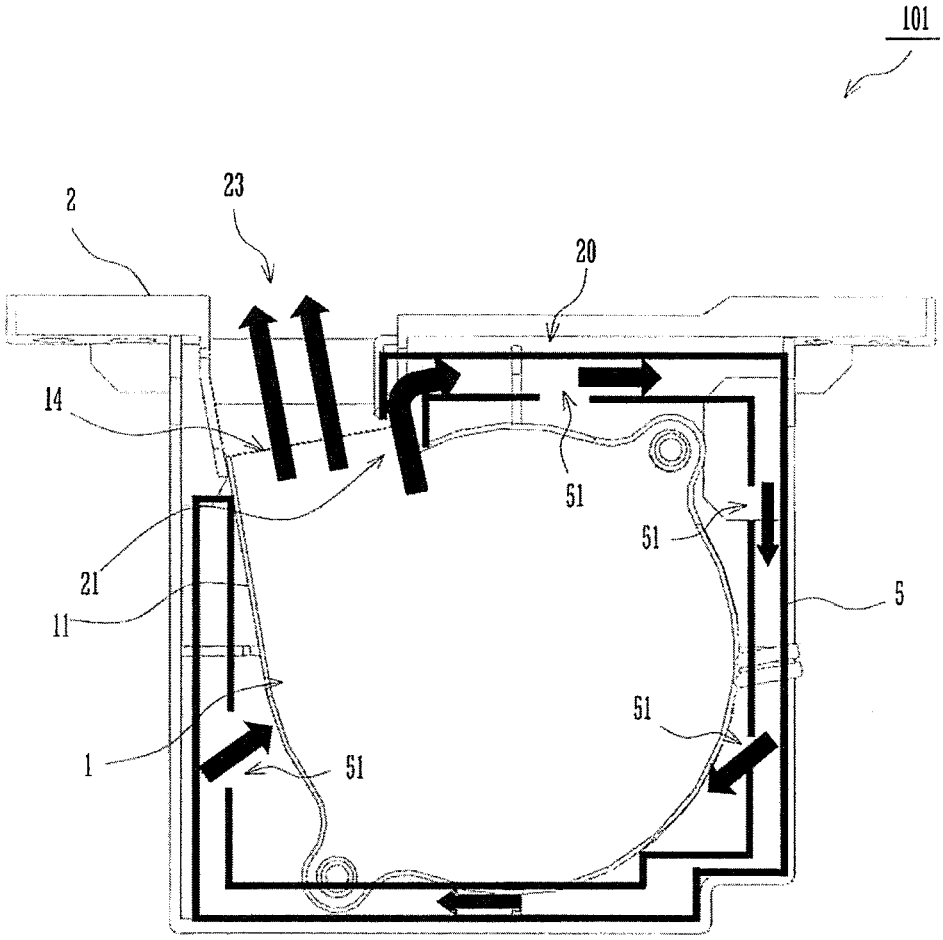
FIG. 5 is a bottom view of a blowing device according to a second preferred embodiment of the present invention.

As shown in FIG. 5, a blowing device 101 according to a second preferred embodiment of the present invention may include a flow path 5 in which air flows along the periphery of a blowing portion 1, in a gap 20. Other configurations are the same as the configuration of the blowing device 10. The flow path 5 may be equipped with a plurality of openings 51 on a part of the wall on the side of the blowing portion 1. With this configuration, the part of the air exhausted from the exhaust outlet 14 can be reliably led to the periphery of the casing 11. In addition, the openings 51 are formed in a portion in the blowing portion 1, required to be especially cooled down, which can thereby improve the cooling property of the blowing portion 1.

Figure 6:
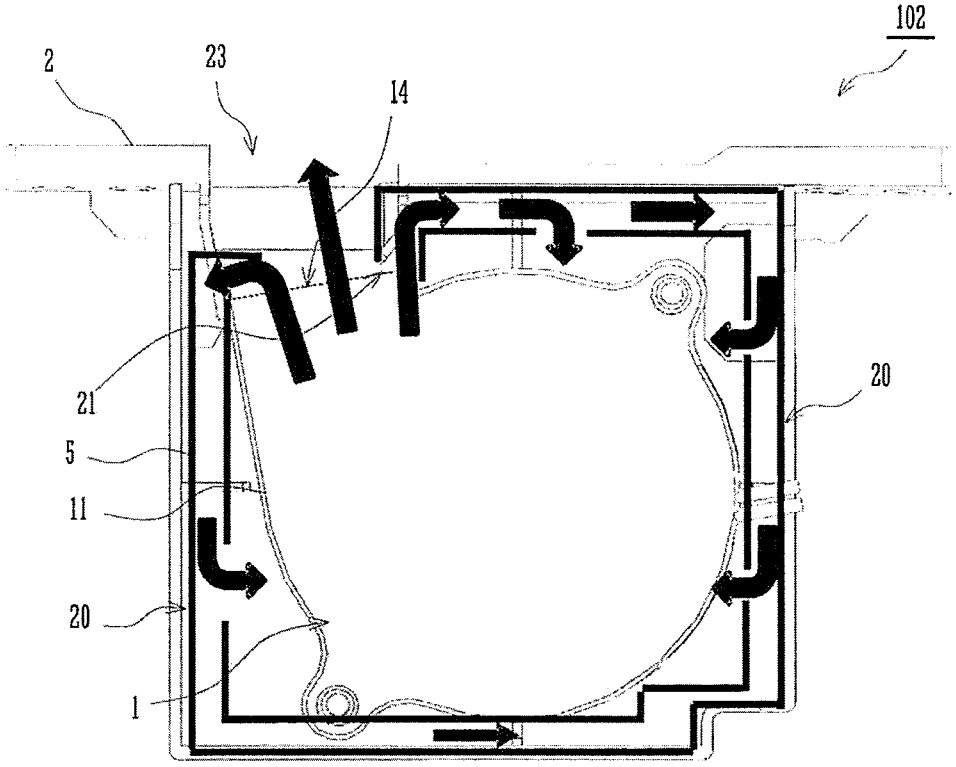
FIG. 6 is a bottom view of a blowing device according to a third preferred embodiment of the present invention.

As shown in FIG. 6, a blowing device 102 according to a third preferred embodiment of the present invention may include a flow path 5 of which the opposite ends are open to an exhaust outlet 14. Other configurations are the same as the configuration of the blowing device 101. The part of air exhausted from the exhaust outlet 14 can be reliably led from the opposite sides of the casing 11 into the gap 20.

It is to be noted that in the blowing devices 101 and 102, the flow path 5 can be formed of a closed cross sectional shaped pipe that is closed except an end portion of the flow path on the side of the exhaust outlet 14 and the openings 51. Moreover, a part or the whole of the upper face and the bottom face may be open outward.

Figure 7:
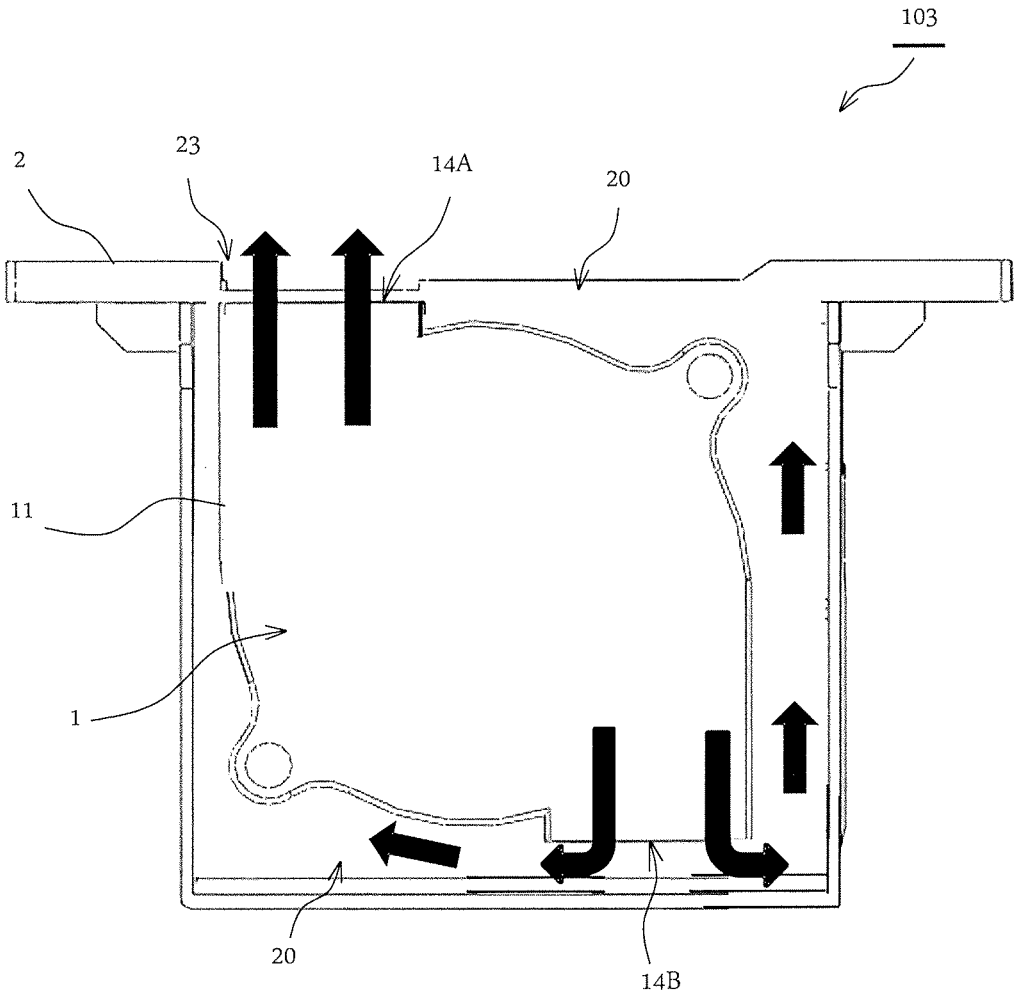
FIG. 7 is a bottom view of a blowing device according to a fourth preferred embodiment of the present invention.

As shown in FIG. 7, a blowing device 103 according to a fourth preferred embodiment of the present invention may include a blowing portion 1 formed with a first exhaust outlet 14A that communicates only with an exhaust portion 23 of a holder 2, and a second exhaust outlet 14B that communicates only with a gap 20. Other configurations are the same as the configuration of the blowing device 10.

Air exhausted from the first exhaust outlet 14A can reliably cool down a sheet of paper discharged to the sheet discharge tray 140, and air exhausted from the second exhaust outlet 14B can reliably cool the blowing portion 1 down. It should be noted that the opening area of the first exhaust outlet 14A and the second exhaust outlet 14B can be appropriately determined based on the ratio of the amount of air required for cooling of a sheet of paper to the amount of air required for cooling of the blowing portion 1.

In addition, as other preferred embodiments, a branch portion 4 of the blowing device 10 may be configured to make it possible to selectively open and close between an exhaust outlet 14 and a gap 20, and, only when the blowing portion 1 needs to be cooled down, the part of air exhausted from the exhaust outlet 14 may be led to the gap 20. Furthermore, the amount of air to be led to the gap 20 may be able to be adjusted.

It is to be noted that, while, in the above preferred embodiments, cases in which the present invention is applied to the image forming apparatus 100 are described, the present invention is characterized in that a blowing portion is configured to cool itself down by using part of air exhausted from the blowing portion and can be similarly applied to a blowing device that is used in a situation in which the temperature rise of the blowing portion causes a problem. Moreover, the blowing portion 1 is not limited to a blowing portion configured with a sirocco fan. Furthermore, for example, the present invention can be similarly applied to a sheet discharge device such as a post-processing device, which is selectively fitted on an image forming apparatus. Additionally, the present invention can be also similarly applied to gas other than air.

The foregoing preferred embodiments are to be considered in all respects as illustrative and not restrictive. The scope of the present invention is defined by the following claims, not by the foregoing preferred embodiments. Further, the scope of the present invention is intended to include the scopes of the claims and all possible changes and modifications within the senses and scopes of equivalents.

What is claimed is:

1. A blowing device comprising:

a blowing portion having a cylindrical body that stores a rotating body, the blowing portion comprising:

a suction inlet arranged on a side surface perpendicular to an axial direction of the cylindrical body and configured to suction gas; and an exhaust outlet arranged on a part of a peripheral surface of the cylindrical body and configured to exhaust the gas along a gas exhaust path; and a holder holding the blowing portion in the holder, the holder comprising:

a wall that faces the peripheral surface with a gap between the wall and the peripheral surface;

a suction portion that communicates with the suction inlet; and an exhaust portion that causes the exhaust outlet to communicate with outside and the gap, wherein:

the exhaust portion includes a branch portion that protrudes from an edge of the exhaust portion and partially facing the exhaust outlet; and the branch portion defines a gap exhaust portion and directs the flow of part of the gas that is exhausted from the exhaust outlet through the gap exhaust portion to the gap.

2. The blowing device according to claim 1, wherein an inclined surface that leads the gas exhausted from the exhaust outlet to the gap is formed at an end portion of the extension portion on a side of the exhaust outlet.

3. The blowing device according to claim 1, wherein the holder further comprises a flow path in which the gas flows along a periphery of the blowing portion.

4. The blowing device according to claim 2, wherein the holder further comprises a flow path in which the gas flows along a periphery of the blowing portion.

5. A holder for holding a blowing portion, the holder comprising:

a wall that faces a peripheral surface of the blowing portion with a gap between the wall and the peripheral surface;

a suction portion that communicates with a suction inlet of the blowing portion; and an exhaust portion that causes an exhaust outlet of the blowing portion to communicate with outside and the gap, wherein:

the exhaust outlet exhausts gas along a gas exhaust path, and the exhaust portion includes a branch portion that extends into the holder and protrudes from an edge of the exhaust portion and partially facing the exhaust outlet; and the branch portion defines a gap exhaust portion and directs the flow of part of the gas that is exhausted from the exhaust outlet through the gap exhaust portion to the gap.

6. A sheet discharge device comprising:

a sheet discharge port that discharges a sheet of paper;

a sheet discharge tray that stores the sheet of paper that is discharged from the sheet discharge port; and the blowing device according to claim 1, wherein the blowing device is arranged so that the exhaust portion is exposed at the sheet discharge port.

7. An image forming apparatus configured to form an image on a sheet of paper by an electrophotographic method, the image forming apparatus comprising:

a sheet discharge port that discharges a sheet of paper;

a sheet discharge tray that stores the sheet of paper that is discharged from the sheet discharge port; and the blowing device according to claim 1, wherein the blowing device is arranged so that the exhaust portion is exposed at the sheet discharge port.

8. The blowing device according to claim 1, wherein the opening is arranged downward from the exhaust outlet in the gas exhaust path.

9. The holder according to claim 5, wherein the opening is arranged downward from the exhaust outlet in the gas exhaust path.

10. The blowing device according to claim 1, wherein:

the wall of the holder includes a wall part that is arranged on a side of the exhaust outlet of the blowing portion and forms a part of the gap between the peripheral surface of the blowing portion and the wall part;

the exhaust portion is provided on the wall part; and the extension portion extends from the edge portion of the exhaust portion on the wall part to the exhaust outlet.

* * * * *